United States Patent [19]

Hirohata

[11] Patent Number: 4,707,946

[45] Date of Patent: Nov. 24, 1987

[54] GRINDING MACHINE

[75] Inventor: Nobuyuki Hirohata, 180-8, Arimoto, Wakayama-shi, Wakayama-ken, Japan

[73] Assignee: Nobuyuki Hirohata, Wakayama, Japan

[21] Appl. No.: 858,795

[22] Filed: May 2, 1986

[30] Foreign Application Priority Data

Feb. 3, 1986 [JP] Japan ..... 61-22550

[51] Int. Cl.[4] ..... B24B 5/04

[52] U.S. Cl. ..... 51/129; 51/166 MH; 51/56 R

[58] Field of Search ..... 51/129, 209 R, 209 DL, 51/166 MH, 166 T, 56 R, 289, 131.1

[56] References Cited

U.S. PATENT DOCUMENTS

| | | | |
|---|---|---|---|
| 432,212 | 7/1890 | Nelson | 51/131.1 |
| 447,860 | 3/1891 | Armstrong | 51/131.1 |
| 1,373,193 | 3/1921 | Lumsden | 51/166 MH |
| 1,968,550 | 7/1934 | Barnes | 51/166 MH |
| 2,023,347 | 12/1935 | Van Valkenburgh | 51/254 |
| 3,299,579 | 1/1967 | Jacobson | 51/206 R |
| 3,555,745 | 1/1971 | Veda | 51/289 |

FOREIGN PATENT DOCUMENTS

| | | | |
|---|---|---|---|
| 0942739 | 2/1949 | France | 51/131 |

*Primary Examiner*—Frederick R. Schmidt
*Assistant Examiner*—Robert A. Rose
*Attorney, Agent, or Firm*—Wenderoth, Lind & Ponack

[57] ABSTRACT

A grinding machine that can continuously grind a rod-like object rotating around its axis supported by a head and a tailstock. Grinding tools are attached to a rotating circular plate which is provided on a carriage that moves along a bed adjacent the axis of the rod-like object at a constant rate to grind the outer surface of the rod-like object. The circular plate includes a front side on which a plurality of first and second grinding tools are mounted. The grinding tools include those for roughing and those for finishing and are mounted along imaginary circles of different radii according to their use in grinding. The plate can be moved up and down so that the rod-like object can be ground with the pertinent tools. That is, a different degree of grinding ranging from roughing to finishing can be performed with different tools in a continuous manner by only changing the height of the circular plate without exchanging the tools.

10 Claims, 6 Drawing Figures

GRINDING MACHINE

BACKGROUND OF THE INVENTION

1. Field of the Invention

This invention relates to a grinding machine for grinding the outer surface of a rod-like object. More particularly, this invention relates to a grinding machine which includes roughing and finishing tools which can rough and finish the outer surface of a rod-like object in a continuous manner without replacing the tools.

2. Description of the Prior Art

In order to grind the outer surface of a rod-like object, at least two grinding steps are required for roughing and finishing. Shaving with tools for use with lathes and grinding with whetstones or buffing cloths are generally adopted in the grinding process.

Incidentally, in shaving with tools for use with lathes, the feed of a carriage has to be slowed down. In addition, it is sometimes necessary to stop operation when exchanging tools. Therefore, the grinding operation suffers from a low working efficiency. Moreover, the accuracy of machining is so poor that the process is unsuitable for finishing such articles as gravure rolls for which a high finishing accuracy is particularly required.

Grinding with whetstones is superior in finishing accuracy. That is, it has an advantage over other finishing processes in that a beautiful surface with twill can be obtained. But on the other hand, a lot of time is required to exchange whetstones, which necessitates stopping the operation and thus lowers the working efficiency. Additionally, the employment of whetstones requires the application of an anticorrosive treatment on them and apparatuses are needed for feeding a solution in order to prevent the choking of the textures of the whetstones and for filtering and recycling the spent solution exhausted therefrom. Accordingly, the cost of the equipment inevitably increases and the disposal of the waste solution is also very expensive.

Grinding with buffing cloths is inferior in durability since the grinding effect wears off soon. In addition, it is difficult to produce a well finished surface because cloths with choked textures tend to cause scratches. As such, a good finish cannot be obtained by buffing.

SUMMARY OF THE INVENTION

Accordingly, it is an object of this invention to provide a grinding machine which can rough grind and finish grind the outer surface of a rod-like object without exchanging tools. It is another object of this invention to provide a grinding machine which can rough grind and finish grind without stopping the operation thereof. It is still another object of this invention to provide a grinding machine suitable for finishing gravure rolls or articles having thin walls or having a high heat-expansion coefficient.

BRIEF DESCRIPTION OF THE DRAWINGS

These and other objects and features of the invention will appear more fully hereinafter from a consideration of the following description taken in connection with the accompanying drawings wherein one example is illustrated by way of example, in which.

DETAILED DESCRIPTION OF THE PREFERRED EMBODIMENT

Figure 1:
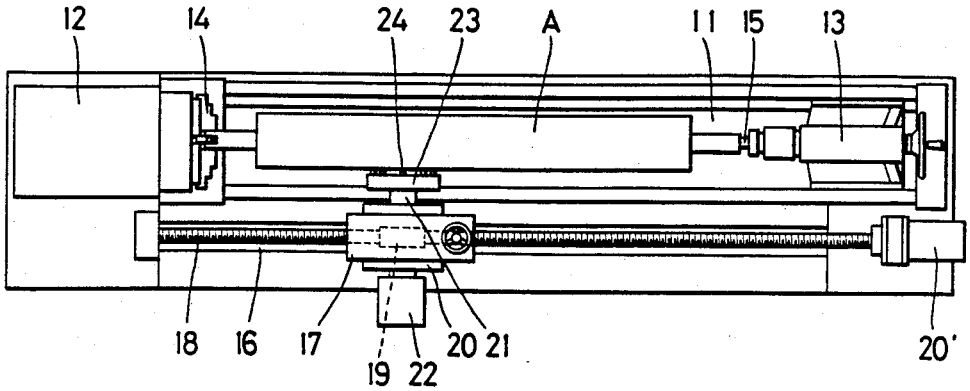
FIG. 1 is a plan view showing a grinding machine of this invention.

As shown in FIG. 1, a headstock 12 and a tailstock 13, which can be moved back and forth freely with respect to the headstock 12, are disposed face to face on a bed 11 at both ends thereof. A rod-like object A to be finished is gripped at one end by a chuck 14 of the headstock 12 and is held at the other end by a tailstock spindle 15. The rod-like object A is rotated around its axis as the chuck 14 rotates.

Figure 2:
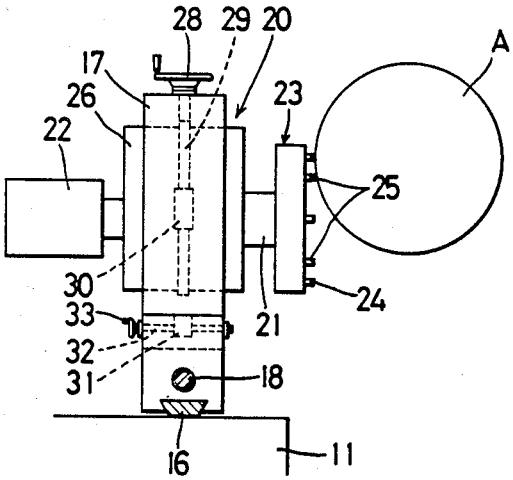
FIG. 2 is a side view of the above grinding machine performing grinding on a rod-like object with its radially outer grinding tools.
Figure 3:
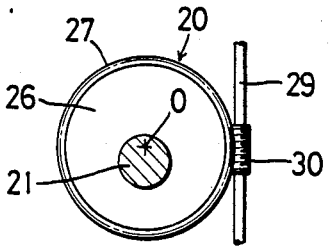
FIG. 3 is a longitudinal cross-sectional view of a mechanism for adjusting the height of the grinding tools shown in FIG. 2.
Figure 4:
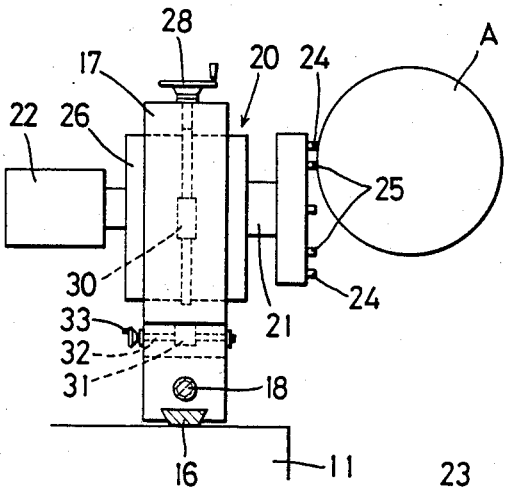
FIG. 4 is a side view of the above grinding machine performing grinding a rod-like object with its radially inner grinding tools.

A carriage 17 can be moved freely along a rail 16 disposed on the bed 11 in a first direction parallel to the axis of the rod-like object A, as shown in FIGS. 2 and 4. The carriage 17 includes a nut 19 which is moved by the rotation of a threaded shaft 18 which is disposed on the bed 11, the threaded shaft 18 being coupled with the nut 19 and driven by a motor 20'.

As shown in FIGS. 2 and 4, the carriage 17 rotatably supports a horizontal shaft 21 which extends in a second direction at right angles to the axis of the rod-like object A by means of a mechanism for adjusting the height of the shaft 21 with respect to the upper surface of the bed 11. The shaft 21 can be rotated freely by means of a motor 22.

A rotary plate 23 for holding a plurality of first grinding tools and a plurality of second grinding tools is secured to an end of the horizontal rotary shaft 21 such that the axis of rotation of the plate is parallel to the shaft 21. The plate 23 is formed into a circular shape and many types of grinding tools 24, 25 are mounted on a flat front side thereof facing the rod-like object A, the front side being parallel to the first direction.

Figure 6:
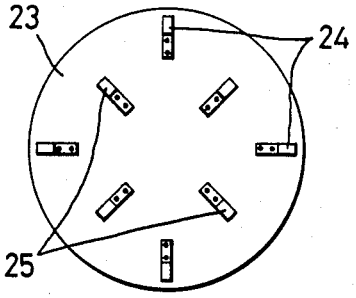
FIG. 6 is a front view of a rotary circular plate on which many types of tools can be mounted.

FIG. 6 shows the disposition of grinding tools mounted on the front side of the circular plate 23. Near the periphery of the circular plate, a plurality of first grinding tools such as four roughing tools 24 are arranged at first positions and at right angles to each other such that they are equidistant or are spaced the same distance from the axis of the shaft 21 along an imaginary circle. Spaced radially inwardly from the four roughing tools are a plurality of second grinding tools such as four finishing tools 25 which are arranged at second positions and at right angles to each other such that they are equidistant or are spaced the same distance from the axis of the shaft 21 along another imaginary circle having a smaller radius. Because of this difference in radius or spacing of the tools from the axis of the plate 23, the roughing and the finishing tools 24, 25 can similarly be positioned adjacent the surface of the rod-like object A to be machined by simply changing the height of the plate 23. With respect to the arrangement of tools, the tools which extend furthest from the front side of the plate 23 should be positioned radially innermost thereon.

As a practical matter, tools used for grinding are not always limited to the two kinds shown in FIG. 6. For instance, a plurality of the same kind of tools can also be used without limit to their number according to specific requirements.

The grinding machine of the present invention includes means 20 for adjusting the height of tools comprising a turn disc 26 which rotatably supports the rotary shaft 21 in an eccentric manner such that the axis of rotation of the turn disc 26 and the axis of rotation of the rotary plate 23 are offset and do not coincide. Means for rotating the turn disc 26 comprises a worm wheel 27 provided on the circumference of the turn disc 26 engaged with a worm gear 30 provided on a worm gear shaft 29 which is disposed on the carriage 17 and which has a hand wheel 28 on the top thereof. With this arrangement, the disc 26 is rotated by turning the hand wheel 28, whereby the rotary shaft 26 is raised or lowered so as to change the height of the tools 24, 25. Furthermore, an upper part of the carriage 17 can be moved in a direction parallel to the axis of the shaft 21 to move the tools towards and away from the rod-like object A in order to adjust the feed for grinding by means of turning a wheel 33 attached to a threaded shaft 32 disposed on a lower part of the carriage 17 and threadedly engaged with a nut 31 connected to the upper part of the carriage 17.

Referring now to the method of using the grinding machine of this invention, at first the rod-like object A to be machined is held for roughing by the headstock 12 and the tailstock 13. Subsequently, the axis of the rotary shaft 21 is lowered beneath the axis of the turn disc 26 in an eccentric rotational manner whereby the radially outermost position of the roughing tools 24 in their circular movement is made to agree with the height of the axis of the rod-like object A.

The motor 22 is actuated in that condition in order to rotate the circular plate 23. The carriage 17 is moved towards the rod-like object A to grind its surface with roughing tools 24, as shown in FIG. 2.

Figure 5:
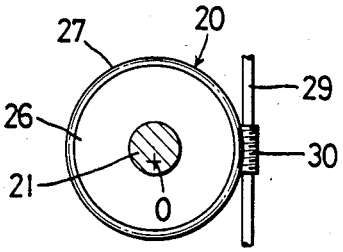
FIG. 5 is a longitudinal cross-sectional view of the same mechanism as the one shown in FIG. 3 for also adjusting the height of the radially inner grinding tools shown in FIG. 4.

In the case of finishing, the carriage 17 is moved backward away from the object A. The turn disc 26 is rotated by turning the hand wheel 28 in order to relocate the axis of rotary shaft 21 above the axis O of the turn disc 26 and make the radially outermost position of the finishing tools 25 in their circular movement agree with the height of the axis of the rod-like object A, as shown in FIG. 5. The carriage 17 is then moved forward to the rod-like object A to grind its surface with finishing tools 25, as shown in FIG. 4.

As stated above, grinding can be made in a continuous manner from rough grinding to finish grinding without exchanging tools by only changing the height of the tools, which greatly improves the working efficiency in grinding. The grinding tools move parallel to the axis of the rod-like object A at a constant rate, rotating around the rotary shaft 21, so that the finish on the rod-like object appears as a twill slanting to the axis thereof and as a result, a good finish is given thereto. The grinding machine of this invention is thus suitable for finishing the surface of gravure rolls. Moreover, it brings out a superior effect in grinding an object having thin walls or which is made of soft metal like aluminum.

What is claimed is:

1. A grinding machine for finishing the surface of a rod-like object which is rotated about an axis of rotation thereof, comprising:

a carriage movable in a first direction parallel to the axis of rotation of the rod-like object and movable in a second direction perpendicular to said first direction;

a shaft extending in said second direction and rotatably supported by said carriage, said shaft being rotatable about an axis parallel to said second direction;

a plate fixedly secured to said shaft for rotation therewith, said plate having a front side which is parallel to said first direction and facing the rod-like object;

a plurality of first grinding tools mounted on said front side of said plate at first positions equidistant from said axis of rotation of said shaft;

a plurality of second grinding tools mounted on said front side of said plate at second positions equidistant from said axis of rotation of said shaft, said second positions being spaced closer to said axis of rotation of said shaft than said first positions; and means disposed on said carriage for adjusting the height of said grinding tools with respect to the axis of rotation of the rod-like object by raising and lowering said rotary shaft.

2. The grinding machine of claim 1, wherein said means for raising and lowering said shaft includes a turn disc rotatably supported on said carriage and means for rotating said turn disc, said turn disc being rotatable about an axis of rotation which is parallel to said axis of rotation of said shaft but offset therefrom, said turn disc rotatably supporting said shaft such that said axis of rotation of said shaft and said axis of rotation of said turn disc are not coincident, whereby rotation of said turn disc effects raising and lowering of said shaft.

3. The grinding machine of claim 2, wherein said means for rotating said turn disc comprises a worm wheel provided on the circumference of said turn disc, a worm gear engaged with said worm wheel, a worm gear shaft disposed on said carriage and fixed to said worm gear and means for rotating said worm gear shaft.

4. The grinding means of claim 3, wherein said means for rotating said worm gear shaft comprises a hand wheel.

5. The grinding machine of claim 1, further comprising means for moving said carriage back and forth in said first direction.

6. The grinding machine of claim 1, further comprising means for moving said carriage back and forth in said second direction.

7. The grinding machine of claim 1, further comprising means for rotating said shaft about said axis of rotation of said shaft.

8. The grinding machine of claim 1, wherein said plurality of first grinding tools comprise four in number.

9. The grinding machine of claim 1, wherein said plurality of second grinding tools comprise four in number.

10. The grinding machine of claim 1, wherein said plurality of first grinding tools comprise four in number and said plurality of second grinding tools comprise four in number.

* * * * *